US005138394A

United States Patent [19]

Watanabe et al.

[11] Patent Number: 5,138,394

[45] Date of Patent: Aug. 11, 1992

[54] CLEANING APPARATUS WITH MEANS TO EFFECTIVELY USE TONER STORAGE SPACE

[75] Inventors: Kazushi Watanabe, Yokohama; Tadayuki Tsuda, Kawasaki; Kazuhiko Ishiwata; Makoto Tanaka, both of Tokyo; Isao Ikemoto, Kawasaki, all of Japan

[73] Assignee: Canon Kabushiki Kaisha, Tokyo, Japan

[21] Appl. No.: 477,514

[22] Filed: Feb. 9, 1990

[30] Foreign Application Priority Data

Feb. 9, 1989 [JP] Japan ..... 1-32386

[51] Int. Cl.[5] ..... G03G 21/00

[52] U.S. Cl. ..... 355/298; 355/299

[58] Field of Search ..... 355/296, 297, 298, 299, 355/300, 301, 302, 303, 304, 305, 306, 260, 265, 15/2565, 251.1, 1.51

[56] References Cited

U.S. PATENT DOCUMENTS

| | | | |
|---|---|---|---|
| 3,927,937 | 12/1975 | de Keyzer | 355/298 |
| 4,140,389 | 2/1979 | Franke et al. | 355/297 |
| 4,251,155 | 2/1981 | Schall et al. | 255/298 |
| 4,530,594 | 7/1985 | Adachi | 355/299 |
| 4,702,591 | 10/1987 | Tsuda et al. | 355/299 |
| 4,868,599 | 9/1989 | Niki | 355/260 |
| 4,876,577 | 10/1989 | Ogura et al. | 355/260 X |

FOREIGN PATENT DOCUMENTS

| | | | |
|---|---|---|---|
| 2207843 | 6/1974 | France . | |
| 0014265 | 2/1981 | Japan | 355/298 |
| 59-155878 | 9/1984 | Japan . | |
| 0004973 | 1/1985 | Japan | 355/304 |
| 60-202462 | 10/1985 | Japan . | |
| 63-23183 | 1/1988 | Japan . | |
| 0153571 | 6/1988 | Japan | 355/299 |

OTHER PUBLICATIONS

Research Disclosure entitled "A Toner Dispensing and Disposal System for Copiers," No. 272, Dec. 1986, pp. 746

*Primary Examiner*—A. T. Grimley
*Assistant Examiner*—J. E. Barlow, Jr.
*Attorney, Agent, or Firm*—Fitzpatrick, Cella, Harper & Scinto

[57] ABSTRACT

The present invention provides an apparatus for the handling of cleaned toner. The cleaning apparatus has a blade which removes residual toner from a photosensitive drum, a storage area partitioned into an upper and a lower section by a plate. In the preferred embodiment, a rotary device with paddles attached feeds toner to the rear of the lower section away from the cleaning blade and into the upper section. This insures the full use of the storage area. Plural rotary devices may be provided.

24 Claims, 1 Drawing Sheet

CLEANING APPARATUS WITH MEANS TO EFFECTIVELY USE TONER STORAGE SPACE

BACKGROUND OF THE INVENTION

1. Field of the Invention

The present invention relates to a cleaning apparatus which removes residual toner from a member to be cleaned and feeds the removed toner to a reservoir by means of a toner feeding means.

2. Related Background Art

According to FIG. 3 showing a sectional view of an image forming system which contributes to the background of the present invention, a photosensitive member 1 is uniformly charged by means of a corona charger 2, and, after a light image 3 has been illuminated onto the photosensitive member to form a latent image thereon, the latent image is developed to form a visualized image with toner by means of a developing device 4. Then, the toner T on the photosensitive member 1 is transferred onto a transfer sheet S by means of a corona charger 5 to form an image. After the transferring operation, the residual toner T' remains on the photosensitive member 1 (member to be cleaned); such residual toner is removed from the member to be cleaned by means of a cleaning blade 6 and is stored or returned to a container 7. The recovered toner T' is fed by a toner feeding means 8 comprising a toner feeding plate 8*a* and elastic members 8*b* rearwardly of a partition plate 10 to be accumulated into a toner reserving portion 11.

In such a cleaning apparatus, there is a need for storing a large amount of toner in accordance with the improvement in the high speed operation and multifunction and/or the durability of the image forming system. However, in the conventional cleaning apparatus as shown in FIG. 3, there arose a problem that the toner could not occupy an upper space in the toner reserving portion 11, and, thus the volume of the toner reserving portion could not be used effectively.

SUMMARY OF THE INVENTION

An object of the present invention is to provide a cleaning apparatus which can utilize the volume of a toner reservoir effectively.

Another object of the present invention is to provide a cleaning apparatus which can improve the durability of the apparatus even if a large amount of toner is stored.

The other objects will be apparent from the following description in connection with the accompanying drawings.

DESCRIPTION OF THE PREFERRED EMBODIMENTS

The present invention will now be explained in connection with embodiments thereof with reference to the accompanying drawings.

Figure 3:
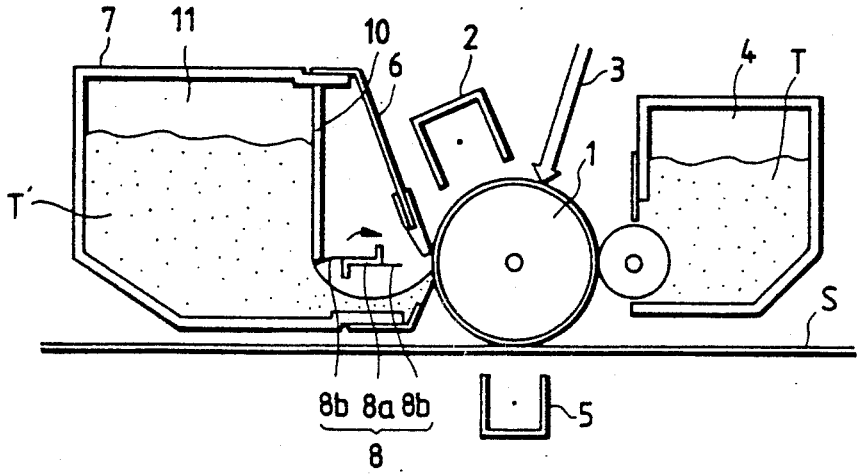
FIG. 3 is a sectional view of an image forming system incorporating a cleaning apparatus contributing to the background of the present invention.

Incidentally, the elements having the same function as those of the elements shown in FIG. 3 will be designated by the same reference numerals.

Figure 1:
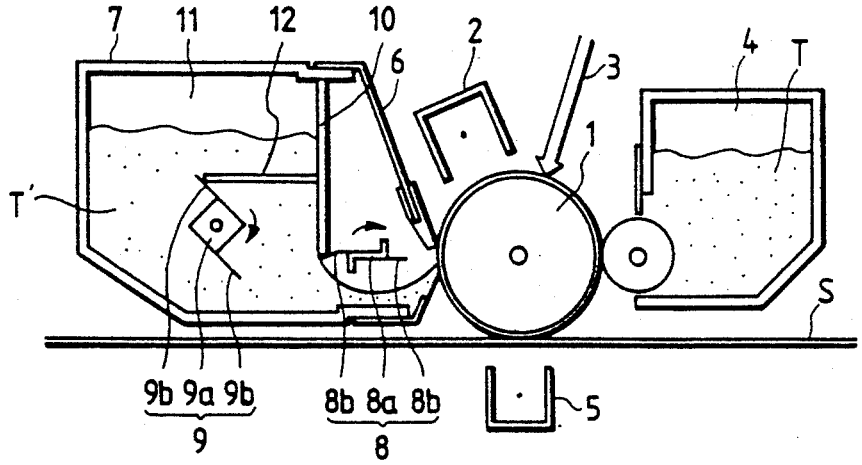
FIG. 1 is a sectional view of an image forming system incorporating a cleaning apparatus according to a preferred embodiment of the present invention.

In FIG. 1, showing a sectional view of an image forming system incorporating a cleaning apparatus according to a preferred embodiment of the present invention, a toner image is formed on a photosensitive member 1 in the same manner as described regarding FIG. 3. After the image has been transferred to a transfer sheet S, the toner T' remaining on the photosensitive member 1 (to be cleaned) is returned or recorded to a toner container 7 by means of a cleaning blade 6. The toner T' is fed by a first toner feeding means 8 comprising a toner feeding plate 8*a* and elastic members 8*b* each constituted by a feeding blade made of material such as Mylar (Trademark), rearwardly of a partition plate 10 (toward a toner reserving portion 11), and is then fed into the interior of the reserving portion 11 upwardly and rearwardly by means of a second toner feeding means 9 comprising a toner paddle 9*a* and elastic toner feeding blades 9*b* made of elastomer material such as Mylar. The paddle 9*a* comprises an elongated rotary prismatic member having a square cross-section and extending in a longitudinal direction of the photosensitive member (i.e., in a direction perpendicular to a plane of FIG. 1). The elastic toner feeding blades 9*b* are attached to flat surfaces of the paddle 9*a* by means of adhesive material and the like. While two elastic toner feeding blades 9*b* are shown, any number of such blades may be used.

Above the second toner feeding means 9, there is arranged a partition plate 12 for dividing the interior of the toner reserving portion 11 into an upper section and a lower section. More particularly, the partition plate 12 serves to divide only a portion of the toner receiving chamber 11; to this end, the partition plate 12 is fixed at its one end to the partition plate 10 and has a free or other end spaced from the inner side surface of the toner container to define a passage through which the toner can move from the lower section to the upper section of the toner reserving chamber 11.

With this arrangement, the toner removed from the photosensitive member is fed, by means of the second toner feeding means 9, into the upper section of the toner reserving chamber 11 through the passage defined between the free end of the partition plate 12 and the inner wall of the toner container.

In this way, by dividing the interior of the toner reserving portion 11 into the upper and lower sections, it is possible to utilize the upper space of the toner reserving portion 11 effectively, thus permitting the storage of a large amount of toner in the toner reserving portion 11. Consequently, in the illustrated embodiment, the durability of the cleaning apparatus can be improved.

Figure 2:
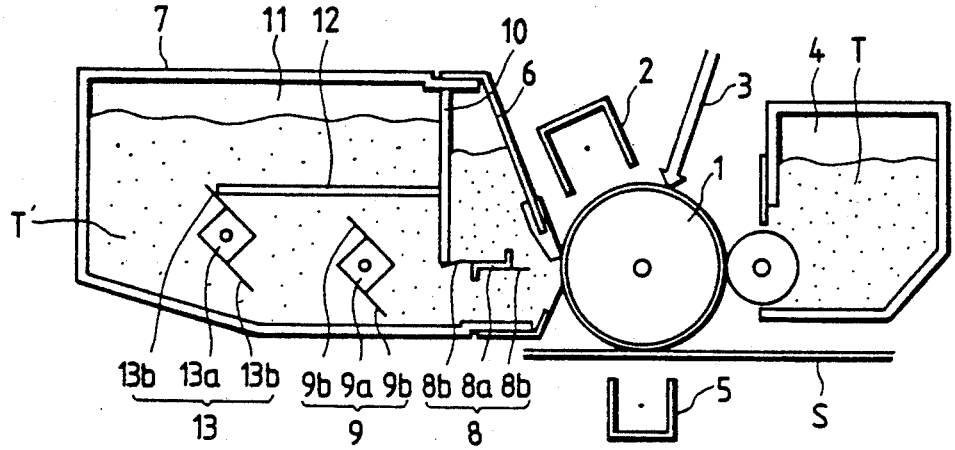
FIG. 2 is a sectional view of an image forming system incorporating a cleaning apparatus according to another embodiment of the present invention.

FIG. 2 shows a sectional view of an image forming system incorporating a cleaning apparatus according to a second embodiment of the present invention. With respect to this second embodiment, only the difference between it and the previous or first embodiment will be explained.

In FIG. 2, as well as the first toner feeding means 8, a second and a third toner feeding means, 9, 13, respectively are arranged in the toner reserving portion 11. A partition plate 12 for dividing the toner reserving chamber 11 into upper and lower sections is also arranged above the second and third toner feeding means 9, 13.

The second toner feeding means 9 mainly serves to feed the toner laterally or horizontally toward the rear of the toner reserving portion 11, and the third toner feeding means 13 mainly serves to feed the toner upwardly above the partition plate 12. In this way, in this second embodiment, it is possible to more completely feed the toner into the upper section of the toner reserving chamber 11, thus permitting the storage of the larger amount of toner in the toner reserving portion 11.

It should be noted that the third toner feeding means 13 comprises a toner paddle 13*a* and elastic toner feeding blades 13*b* made of elastomer material such as Mylar, like as the second toner feeding means 9 shown in FIGS. 1 and 2.

Incidentally, while the elastic toner feeding blades 9*b* of the second toner feeding means 9 of FIG. 1 and the elastic toner feeding blades 13*b* of the third toner feeding means 13 of FIG. 2 were shown to contact the respective partition plates 12, these blades 9*b* , 13*b* may be arranged so as not to contact the respective partition plates.

Further, while a plurality of toner feeding means were provided in the cleaning apparatuses shown in FIGS. 1 and 2, it is not necessary to provide the plural toner feeding means, but only a single toner feeding means may be used. However, in order to feed the toner to the rearmost and/or uppermost portion of the toner reserving chamber to store the large amount of toner therein, it is preferable to use the plural toner feeding means.

In addition, according to the illustrated embodiments mentioned above, since the load applied to the toner feeding means arranged in the toner reserving chamber can be reduced by an amount corresponding the weight of the toner supported on the partition plate 12, the load applied to a driving mechanism (such as gearing) for driving the toner feeding means can also be reduced, therebY preventing the damage of the toner feeding means and/or the driving mechanism therefor.

As mentioned above, while the present invention has been explained in connection with the particular embodiments, the present invention is not limited to such embodiments, and various alterations and/or modifications may be made without the departure from the spirit of the invention.

We claim:

1. A cleaning apparatus featuring effective use of toner storage space, comprising:

removing means for removing residual toner from a member to be cleaned;

storage means for reserving the residual toner removed from said member to be cleaned;

a partition member for dividing the interior of said storage means into upper and lower sections which communicate with each other; and feeding means disposed in the lower section of said storage means, said partition member being positioned above said feeding means, said feeding means conveying the toner in a direction from the lower section to the upper section.

2. A cleaning apparatus according to claim 1, wherein said partition member comprises a plate and divides a portion of the interior of said storage means into said upper and lower sections.

3. A cleaning apparatus according to claim 2, wherein said partition member has a free end defining a passage through which the residual toner can move and which communicates said lower section with said upper section.

4. A cleaning apparatus according to claim 3, wherein a portion of said feeding means contacts said free end of said partition member defining said passage.

5. A cleaning apparatus according to claim 1, wherein said feeding means is positioned so as to contact an end of said partition member in a vertical direction.

6. A cleaning apparatus according to claim 5, wherein said feeding means feeds the residual toner in a direction along said partition member.

7. A cleaning apparatus according to claim 1, further comprising a second feeding means disposed proximate to said first feeding means and being provided to feed the residual toner toward the rear and upper portions of said storage means.

8. A cleaning apparatus according to claim 1, wherein said feeding means comprises a rotary member including a paddle and at least one elastic member attached to said paddle.

9. A cleaning apparatus according to claim 8, wherein said paddle comprises a prismatic member.

10. A cleaning apparatus according to claim 9, wherein said elastic member is attached to a flat side surface of said paddle.

11. The cleaning apparatus according to claim 1, wherein said partition member is positioned above at least a portion of said feeding means.

12. The cleaning apparatus according to claim 1, wherein said feeding means operates to push up the toner on said partition member.

13. The cleaning apparatus according to claim 1, wherein said feeding means is a rotational member in which flat resilient members are attached to surfaces of a shaft having a square cross section.

14. The cleaning apparatus according to claim 1, wherein said feeding means is a rotational member in which flat resilient members are attached to side surfaces of a square shaft, said resilient member abutting against an end of said partition member in every rotation thereof.

15. The cleaning apparatus according to claim 1, further comprises a second conveying means being disposed below said partition member, for conveying the toner toward said feeding means.

16. The cleaning apparatus according to claim 1, wherein said member to be cleaned is an electrophotographic photosensitive body.

17. A recording apparatus having cleaning function and effecting recording on a recording medium, comprising:

an image bearing body;

imaging forming means for forming an image on said image bearing body;

transfer means for transferring the image formed on said image bearing body by said image forming means onto a recording medium;

removal means for removing a residual toner on said image bearing body;

storage means for storing the toner removed by said removal means;

a partition member for partitioning the interior of said storage means into upper and lower sections which communicate with each other; and feed means, positioned below said partition member, for feeding the toner to the upper section defined by said partition member.

18. The recording apparatus according to claim 17, wherein said image bearing body comprises an electrophotographic photosensitive body.

19. The recording apparatus according to claim 17, wherein said image forming means comprises an electric discharger.

20. The recording apparatus according to claim 17, wherein said image forming means comprises developer.

21. The recording apparatus according to claim 17, wherein said transfer means comprises an electric discharger.

22. The recording apparatus according to claim 17, wherein said removal means comprises a cleaning blade.

23. A cleaning apparatus for cleaning a toner from a member to be cleaned, comprising:

removal means for removing the toner from the member to be cleaned;

storage means for storing the toner removed from the member to be cleaned by said cleaning means;

a partition member for partitioning interior of said storage means into upper and lower sections which communicate with each other; and feed means for feeding the toner from the lower section to the upper section partitioned by said partition member.

24. A recording apparatus having cleaning function and effecting recording onto a recording medium, comprising:

an image bearing body;

image forming means for forming an image on said image bearing body;

transfer means for transferring the image formed on said image bearing body by said image forming means onto the recording medium;

removal means for removing a residual toner on said image bearing body;

storage means for storing the toner removed by said removal means;

a partition member for partitioning interior of said storage means into upper and lower sections which communicate to each other; and feed means for feeding the toner from the lower section to the upper section partitioned by said partition member.

* * * * *

UNITED STATES PATENT AND TRADEMARK OFFICE

CERTIFICATE OF CORRECTION

PATENT NO. : 5,138,394

DATED : August 11, 1992

INVENTOR(S) : WATANABE ET AL.

It is certified that error appears in the above-identified patent and that said Letters Patent is hereby corrected as shown below:

COLUMN 3

Line 42, "thereby" should read --thereby--.
Line 55, "residual toner" should read --toner--.

COLUMN 4

Line 16, "a second" should read --another--.

Signed and Sealed this

Twenty-first Day of September, 1993

Bruce Lehman

*Attest:*

BRUCE LEHMAN

*Attesting Officer*

*Commissioner of Patents and Trademarks*